United States Patent [19]

Wegener et al.

[11] 4,262,648

[45] Apr. 21, 1981

[54] SOFTBALL PITCHING MACHINE

[75] Inventors: John A. Wegener, Gloucester City; Joseph F. Garvey, Haddon Heights, both of N.J.

[73] Assignee: Slo-Pitcher, Inc., Camden, N.J.

[21] Appl. No.: 968,343

[22] Filed: Dec. 11, 1978

[51] Int. Cl.[3] ..... F41B 3/04

[52] U.S. Cl. ..... 124/6; 124/50; 124/32; 273/260

[58] Field of Search ..... 124/6, 32, 41 R, 50, 124/7; 221/9, 10, 13, 12; 414/748, 125; 74/25, 27; 273/26 D

[56] References Cited

U.S. PATENT DOCUMENTS

| | | | |
|---|---|---|---|
| 2,700,379 | 1/1955 | Brigati | 124/7 |
| 3,470,859 | 10/1969 | Ponza | 124/7 |

*Primary Examiner*—William R. Browne
*Attorney, Agent, or Firm*—Edward M. Farrell

[57] ABSTRACT

A machine is provided for pitching one or more balls at selected intervals by selectively connecting a clutch mechanism to a pitching arm.

10 Claims, 4 Drawing Figures

SOFTBALL PITCHING MACHINE

Ball throwing devices are well known and have taken a wide variety of different forms. Such devices have been used for pitching baseballs, tennis balls and the like to enable individuals to practice and become more proficient in a particular sport.

Softball machines for pitching balls for practicing slow pitch softballs pose special problems. For example, the speed of the ball pitched must generally be slower and delivered at different trajectories than those used for conventional baseball and tennis games. Softballs are generally bulkier than baseballs and tennis balls.

Because of the special problems involved in slow pitch softball practice machines, the machines employed for pitching must generally be stronger and capable of delivering greater constant forces over long periods of time. Consequently, biased springs which build up tensions and which are suddenly released to cause a ball to be pitched, as found in many conventional baseball and tennis ball machines, are generally not adequate for slow pitch softball pitching machines.

Some of the automatic pitching machines used heretofore have proven unsafe. For example, some electrically driven machines may store up large amounts of energy by building up tensions in springs or the like so that they can throw a ball even when the machine is turned off or unplugged or triggered by an unsuspecting person handling the machine.

Some patents relating to the ball pitching machines include a "Spring Operated Ball Pitching Device," U.S. Pat. No. 3,754,544; "Mechanical Ball Throwing Device," U.S. Pat. No. 3,722,494; "Spring Type Projecting Device," U.S. Pat. No. 3,779,227, and "Baseball Pitcher," U.S. Pat. No. 1,821,755.

It is an object of this invention to provide an improved machine for automatically pitching softballs to enable a person to practice and improve his batting.

It is a further object of this invention to provide an improved ball pitching machine which does not store energy when it is disconnected from a power source.

It is a further object of this invention to provide an improved machine for automatically pitching softballs in which various time control means are employed to provide safety after loading the machine with balls and for varying the time intervals between pitches.

It is still a further object of this invention to provide an improved machine for automatically pitching softballs in which the speed of the balls and the angles at which they are pitched are readily varied.

It is still a further object of this invention to provide an improved machine for automatically pitching softballs which is relatively rugged and whose characteristics are not subject to substantial changes over relatively long periods of time.

It is a further object of this invention to provide an improved ball pitching machine which is capable of handling softballs in all conditions of wear, irregular shapes and the like.

It is a still further object of this invention to provide a novel pitching arm for a ball pitching machine which causes the ball to be accelerated when it leaves the machine.

In accordance with the present invention, a machine for pitching one or more balls at selected intervals, at variable predetermined speeds and at variable predetermined angles is provided. A continuously driven motor, driven by conventional power, includes a pulley arrangement with a flywheel connected thereto. A clutch is actuated to selectively connect the flywheel to a pivotable ball dispensing arm for one revolution of the flywheel to cause the arm to be moved abruptly forward and back about an angle to release a ball disposed on the end thereof. One or more balls are delivered one at a time either by manual operation or automatically at selected time intervals. If desired, various timing circuits are sequentially operated after loading of the balls to assure operation of the machine only when there are balls present to be delivered with the delivery of the first ball after loading being delayed for safety purposes. The timing circuits also control the time intervals of the pitching of the balls, and cause the clutch to be actuated at the proper time when balls present are to be pitched. The ball dispensing arm is slightly flexible to cause controlled acceleration to the balls as they are released from the arms.

Other objects and advantages of the present invention will be apparent and suggest themselves to those skilled in the art, from a reading of the following specification and claims, taken in conjunction with the accompanying drawings in which:

Figure 1:
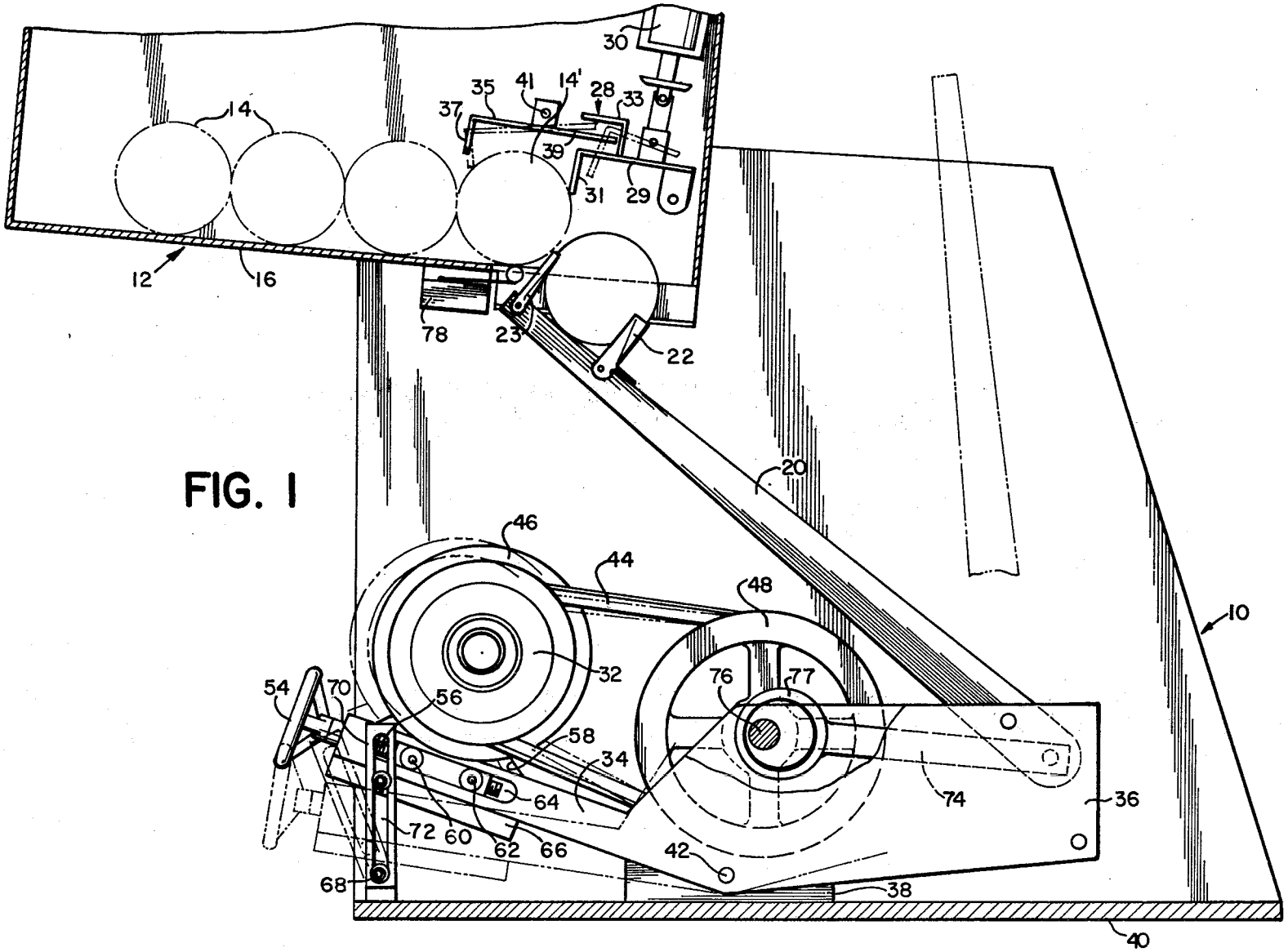
FIG. 1 is a side view of a ball pitching machine, in accordance with the present invention.
Figure 2:
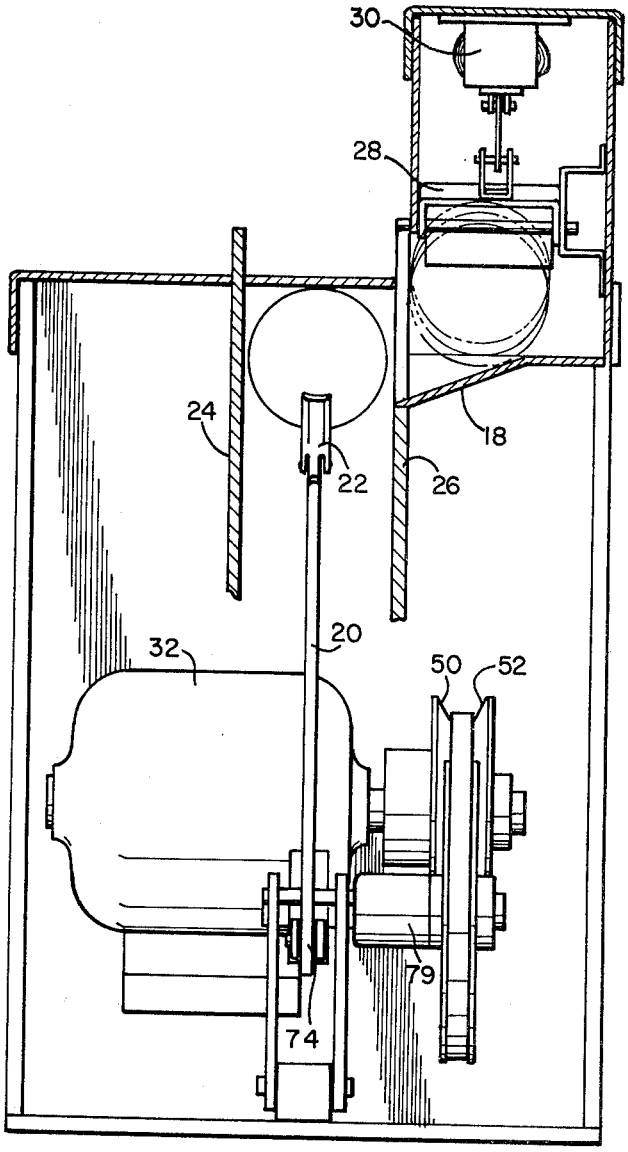
FIG. 2 is a front view of the machine illustrated in FIG. 1.

Referring particularly to FIGS. 1 and 2, the softball pitching machine 10 comprises a chute 12 adapted to hold a plurality of softballs 14. The chute 12 includes side and bottom walls and is open at the top and front. The chute is slightly tilted to permit the balls to roll under the force of gravity. One of the side walls of the chute is shorter at one end to permit the bottom-most ball 14' to freely roll from the bottom wall 16 over a ramp 18 onto the end of a pitching arm 20 when it is released from the chute 12. The pitching arm 20 includes a ball holding member 22 shaped to receive and hold a ball and may be disposed between a pair of spacer stationary guard plates 24 and 26. An element 23 keeps the ball on the arm. The balls 14 are delivered to the end of a pitching arm 20 one at a time for delivery to a player for practice. It is apparent that different types of chutes may be employed. For example, the chute may be in alignment with the ball arm to drop the balls directly onto the pitching arm.

The bottom-most ball 14' is normally held in position by a lever arm 28 which is adapted to be raised as a result of the operation of a solenoid 30 at selected times for selected time intervals, as will be described. The arm 28 comprises a main portion 29 connected to the relay 30 and an end portion 31 extending downwardly at right angles thereto to hold the bottom-most ball 14' until the relay 30 is actuated. An L shaped section 33 provides a slot for an arm and is attached to the end of the section 37 and arm 39. The element 35 is pivoted about a point 41. When the arm 28 is raised, the bottom-most ball 14' rolls out of the chute 12 at a right angle onto the end of the pitching arm 20, where it is held in place by the ball holder member 22. The pitching arm 20 is disposed out of alignment with respect to the chute 12 to permit free arcuate movement thereof. When the arm 28 is raised, it moves the arm 39 up about the pivot point 41. This causes the end 37 to move down to block the remaining balls when the bottom-most ball 14' is released.

A motor 32 is mounted to means 58 which secures the motor to a base 34, which is connected to a swivel block 36. The sub-frame member or swivel block 36 is pivotally connected to the mount 38 through a pivot pin 42. The mount 38 is connected to the base 40 of the machine.

A variable speed pulley arrangement includes a pulley belt 44 connecting a wheel 46 to a flywheel 48. The wheel 46 may be of a type in which the pulley belt 44 is disposed between a pair of spaced elements 50 and 52 movable with respect to each other and normally biased towards each other to take up any slack in the pulley belt 44 which may result from moving the motor 32 closer to or further from the flywheel 48. Moving the motor 32 towards or away from the flywheel 48 in effect varies the coupling of the pulley belt 44 to vary the speed of the flywheel 48. Such variable pitch diameter pulley arrangements are well known to those skilled in the art. Such variable wheels 46 are commercially available.

The position of the motor 32 may be changed, and consequently the pulley coupling and speed of the flywheel 48, by rotation of handle 54 which is connected to rotate a threaded member 56. The threaded member 56 threadedly engages the movable base element 58 to which the motor 32 is secured. The base element 58 is connected to a pair of pins 60 and 62, which may include suitable tightening means, which guide the movement of the base element 58 within a slot opening 64 of the base 34. Varying the pulley pitch diameter by moving the motor 32 with respect to the flywheel 48 provides the means for selectively varying the speeds at which balls may be pitched.

The base 34 includes an extension 66 attached thereto which include a guide pin 68 which may include a tightening adjustment screw. A slotted member 70 is pivotally connected to the base 40 and receives the guide pin 68 within its slot opening 72. The entire mechanism including the motor 32, swivel block 36 and various assemblies connected thereto are adapted to be moved up and down about a small arc in accordance with the position of the guide pin 68 within the slot opening 72. This arrangement provides means for selectively varying the arcs at which balls may be pitched.

The pitching arm 20 is connected to a pivoted arm arrangement including a lever arm 74 having one end 77 connected to a cam shaft 76. The cam shaft 76 is eccentrically mounted to the end 77 of the arm 74 to be selectively driven by the flywheel 48. The arm 74 is normally mechanically disengaged from the flywheel 48 as when the arm 20 is in the position illustrated. When the cam shaft 76 is connected to the flywheel 48 through a clutch mechanism 79, it is rotated for one revolution of the flywheel 48 to cause the pitching arm 20 to move forward and back about a relatively small angle to pitch any ball which may be on the ball holder 22. The cam shaft 76 returns to its original position after a ball is pitched and remains disengaged from the flywheel 48 until the next ball is pitched.

The clutch mechanism may be of the type used in conventional punch presses wherein a clutch mechanism is used to permit the ram to be lowered and raised for each cycle. While conventional in presses, it is believed that the use of such an arrangement in the present invention makes it possible to provide advantages not found in prior art ball pitching machines. Details of the clutch are illustrated in FIG. 3.

During operation of the machine, the ball 14 rolls down the chute 12 onto the end of the pitching arm 20. The clutch mechanism 79 is then actuated to connect the flywheel 48 to the cam shaft 76 to cause the cam shaft 76 to be rotated for one revolution. When this happens, the pitching arm 20 is rotated about a small angle to deliver the ball which is held by the ball holding means 22. The pitching arm 20 then delivers the ball and then returns to it its original position. At this point, the lever arm 28 is actuated to permit the next ball 14 to roll into the ball holding means 22 in preparation for the next ball delivery.

As will be described in connection with the electrical circuit in FIG. 4, the forward-most ball 14' actuates a microswitch 78 to close a circuit. If there is no ball 14' in position, the microswitch 44 will remain opened and no further operation of the machine will take place.

Figure 3:
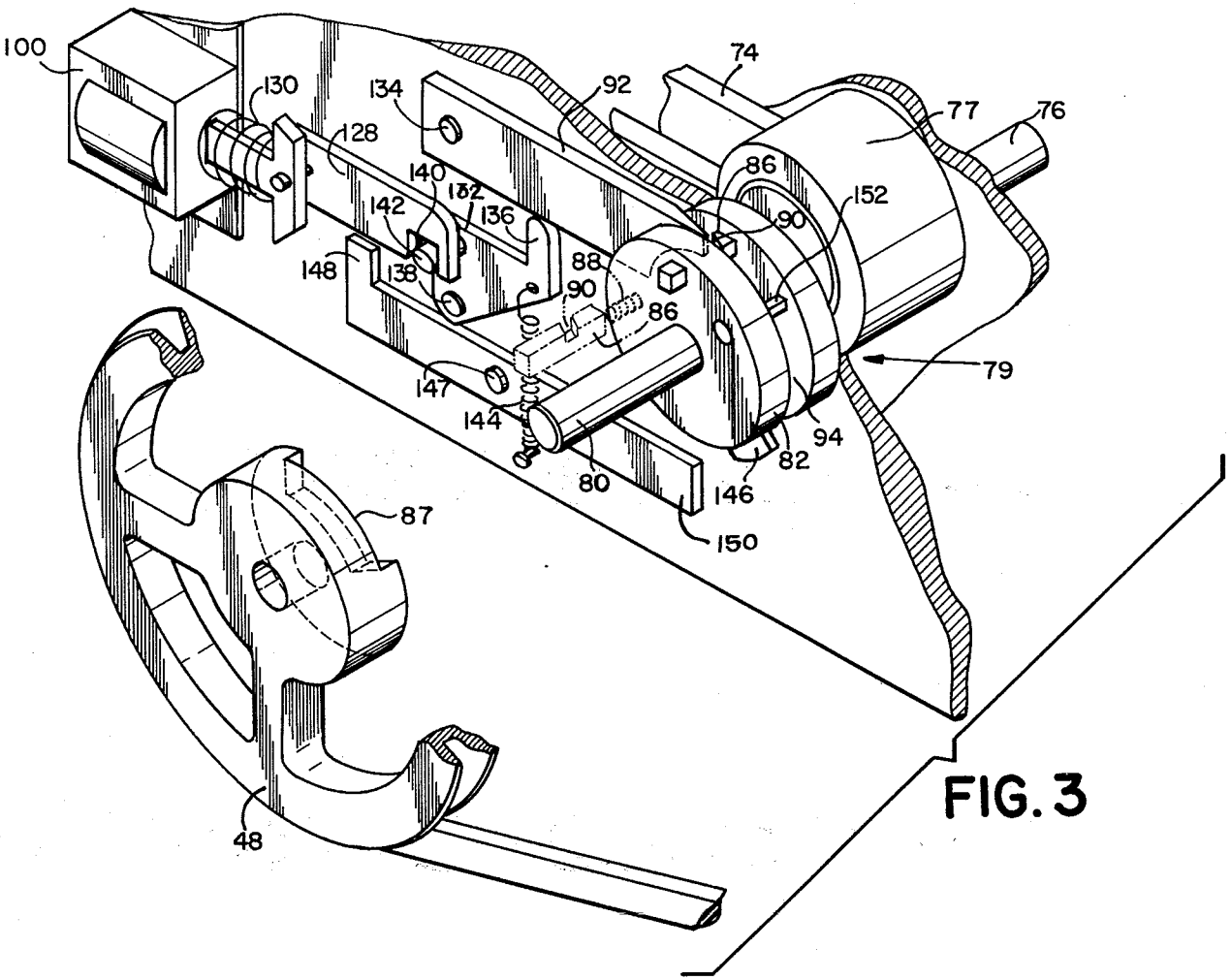
FIG. 3 is an exploded view illustrating a clutch arrangement as used in the present invention.

Referring particularly to FIG. 3, along with FIGS. 1 and 2, the clutch mechanism 79 is normally in a position so that the flywheel 48 is mechanically disconnected from the shaft 76, which is eccentrically mounted to the end 77 of the arm 74 which is disposed to actuate the ball pitching arm 20. As will be described with the electrical operation in connection with FIG. 4, the clutch mechanism 79 is actuated a short time to connect the flywheel 48 to drive the eccentric shaft or cam 76 for a single revolution of the flywheel 48, with the operation being repeated as a result of subsequently applied signals.

The flywheel 48 is attached to freely rotate on a shaft 80. The flywheel 48 includes a cut-away arcuate slot 87 disposed to receive a floating pin therein.

A floating key or pin 86 is disposed within a recess within a coupler 82 and normally is biased outwardly therefrom by a spring 88. The floating key or pin 86 includes a cutaway slot 90 slanted on one side. A member 92, wedge shaped at one end, is disposed within the slot 90 to hold the floating key 86 against the bias of the spring 88 within the coupler 82 when the coupler is not driven by the flywheel 48.

The member 92 is normally biased within the groove 94 of the coupler 82 by gravity or any other suitable means. The solenoid 100 is operated by the application of an electrical signal thereto to cause the wedge member 92 to move out of the groove 94.

The solenoid 100 is connected to move an arm 128, which is normally biased outwardly by a spring 130. A pivotable element 132 is disposed close to the wedge element 92 which may be pivoted about point 134. When the protruding upwardly extending end 136 of the arm 132 is pivoted upwardly about a pivot point 138, the wedge member 92 is moved out of the groove 94.

The end of the arm 128 includes a slot opening 140 for receiving an arm 142 which is secured to the pivotable element 132. A spring 144 normally maintains the end portion 136 away from the wedge member 92. Operation of the relay 100 causes the arm 128 to be moved to the left to raise the end portion 136 to cause the wedge member 92 to be removed from the slot 94.

An arm 146, pivotable about point 147, includes an upwardly extending portion 148 for contacting the arm 128 and an end 150 for contacting the pin 146 when the coupler 82 is rotated to the area of contact.

In operation, the flywheel 48 is rotated for a single revolution when the clutch mechanism is operated. As soon as the wedge member 92 is removed from the groove 94 to actuate the pin 86, it is desired to have the wedge member return as soon as possible to the groove. Thus the timing of the time delay circuits is not critical for this operation. This is accomplished by the pin 146 contacting the end 150, which in turn moves the arm 128. Upward movement of the arm releases the pin 142 from the slot 140. The end 136 moves away from the wedge member 92 to permit it to return to the groove 94. A stop pin 152 is provided in the groove to provide a reference stopping point for the coupler.

When the wedge member 92 moves out of the groove 94, the floating key 86 is forced out of the coupler 82 by the spring 88. As mentioned, the flywheel 48 is normally continuously driven by the variable speed pulley 46. When the slot 87 of the flywheel 48 is in alignment with the pin 86, it will receive the pin therein. The flywheel 48 will then drive the coupler 82 for one revolution.

The solenoid 100 is operated for a very short time to cause the wedge element 92 to be moved out of the groove 94 to release the pin 86 and back into the groove of the coupler 82. After the coupler 82 is rotated for one revolution of the flywheel 48, the cutaway slot 90 of the pin 86, moving counterclockwise, receives the pointed wedge member 92 therein. After the clutch goes through a partial rotation it automatically allows the wedge member 92 to return. The member 92 forces the floating pin 86 back into the recess of the coupler 82 thereby disconnecting the flywheel 48 from the clutch mechanism 79. The clutch mechanism 79 remains unactuated until another signal is applied to the solenoid 100 to withdraw the member 92 from the coupler 82.

When the coupler 82 is rotated for one revolution of the flywheel 48, the cam shaft 76 rotates the end 77 of the arm 74 to cause the pitching arm 20 to be moved abruptly back and forth to pitch a ball.

In considering the machine illustrated and described thus far, three basic functions must be considered with respect to the electrical controls. The first relates to providing a time delay after starting the machine to assure that the pitching arm is not actuated immediately after starting. A second function which is controlled electrically relates to the release of the individual balls from the ramp to the pitching arm. The third function relates to the operation of the clutch mechanism which controls pitching of the balls. The operation of the electrical circuitry will be described in connection with the mechanical components of the machine. The second and third functions are actuated by the same signal and in one respect may be considered electrically interlocked, i.e., one will not continue to operate with the other, and vice versa.

Figure 4:
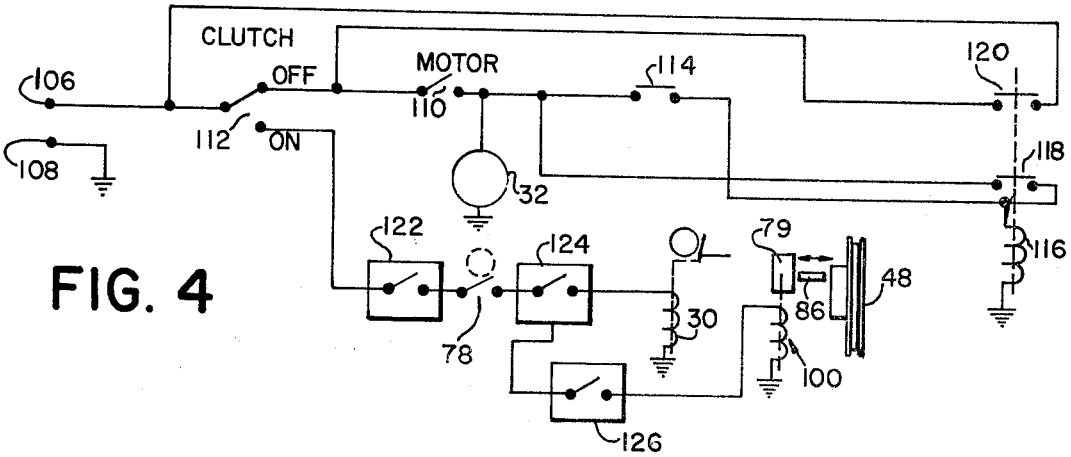
FIG. 4 is a schematic electrical diagram illustrating the sequence of operations of the machine illustrated in FIGS. 1 and 2.

Referring to FIG. 4, along with the previous figures, a source of power is applied to a pair of input terminals 106 and 108. This source of power may be a conventional source of 110 volts AC. The terminal 108 is returned to a point of reference potential, designated as ground.

The first step required to put the machine 10 into operation is to start the motor 32 by manually closing a switch 110. Before closing of the switch 100 is effective to operate the motor 32, a clutch switch 112 must be in an "off" or upper position. If the clutch switch 112 is in the "on" or down position during the starting operation, closing of the switch 110 will have no effect on the motor 32.

After the motor 32 is started, a momentary or push-button switch 114 is closed to permit current to flow from the power source terminals 106 and 108 through the switch 110, the momentary switch 114 to energize a relay coil 116. The current through the relay coil 116 closes contact arms 118 and 120 with each closing a pair of contacts. Arm 118 and its associated contacts comprise a holding circuit to maintain current through the coil 116 after the momentary switch 114 is released or opened. This keeps contact arms 118 and 120 closed. The closed contacts closed by the arm 120 in effect short out or bypass the "off" position of the clutch switch 112. Consequently, when the clutch switch 112 is subsequently switched to the "on" position, current will continue to flow in the motor 32 and in the relay coil 116.

Following the start up of the motor 32 and operation of the circuits described, the clutch switch 112 is turned on to permit operation of the clutch mechanism 79, after suitable delays, to permit balls to be pitched. When the switch 112 is closed, current flows from the power source 106 to a time delay circuit 112 which produces a time delay, for example 15 seconds before power is applied to subsequent circuits. This may be a conventional type time delay relay of the slow operate type. Upon the application of power, the time delay begins. At the end of the time delay, an output relay is operated. When the input power is removed, the output relay returns to normal and the timer circuit is reset. Such time delay relays are well known and may be of the type Dayton Timer Stock #5X829 manufactured by W. W. Grainger, Inc. 5959 W. Howard St., Chicago, Ill. At the end of 15 seconds, or other set desirable time period, current is permitted to flow through the switch 78 indicative of the presence of a ball on the chute, through the time delay circuit 122 to a timer circuit 124, which in turn is connected to timer circuit 126.

In a preferred embodiment, the timer circuit 124 may, for example, be a five second timer and the timer circuit 126 may, for example, comprise a one second timer. It is understood that the specific times involved in all the time delays mentioned may be varied dependent upon the design of the particular mechanical requirements of the machine involved.

The five second timer circuit 124 may be of the slow release type. Upon application of input power and closure of an external switch, an output relay operates. Upon opening at the external switch, a time period begins. At the end of the time period, the output relay returns to normal. Any external switch reclosures prior to the end of the time period will immediately reset the timer circuit. The timer circuit 124 may be of the type 6X153, manufactured by the manufacturer mentioned above. The one second timer 126 may be of the slow operate type similar to the timer 122. This may be type 5X828 manufactured by the same manufacturer mentioned above.

At the end of the five second delay provided by the timer, circuit 124 and the opening of the microswitch 78 resulting from a ball leaving the chute (FIG. 1), a solenoid coil 30 actuates the release arm 28 as illustrated in FIG. 1, to release the ball 14' from the chute onto the end of the pitching arm. At the end of one second, current through the relay coil 100 operates the clutch mechanism 79. When the clutch mechanism 79 is actuated, the pin 86 is moved to engage the flywheel 48. The turning of the flywheel 48 causes the pitching arm 20 to be moved to deliver a ball as illustrated in FIGS. 1 and 2, and described in detail in connection with FIG. 3.

It is thus seen that the time delay circuit 122 provides an initial time delay after the machine is started and does not thereafter affect the operation of the machine as long as power is applied. If the power is disconnected, or if the clutch switch is off or if the motor switch is deactuated, the time delay will start again before the machine can be mechanically operated.

The time delay circuit 126 causes the operation of the clutch mechanism 79 for a very short time less than one second. It is operated every five seconds because of the opening of the microswitch 78 and discontinuance of the operation of the timer 124 as a result of the ball leaving the chute. At the same time, the timer circuit 124 controls the dispensing of the balls 14, causing one ball to be released every five seconds.

In experimenting with the machine illustrated, it was found that the pitching arm 20 should be slightly flexible so that it will flex during the final in flight release of a ball. This flexing adds momentum to the ball. If the pitching arm 20 is too stiff, as when rigid metal is used, desirable velocity of the ball is not achieved. It was found that plastic of sufficient thickness for the required strength along with a slight flexing to add momentum upon release of the ball resulted in highly improved and somewhat surprising results. Nylon-Delrin was used successfully although it is likely that other plastics with similar characteristics could be used. Composite design using various materials may also be used.

It is thus seen that the present invention has provided an improved machine for pitching softballs in which maximum momentum is achieved by a pitching arm which is strong enough to hold and pitch a ball and, at the same time, flexible to add force to the balls as they are pitched. Further, the electrical circuits and mechanical design parameters assure that no energy is stored in the pitching arm between operations, which may result in injuries. Further a time delay prevents immediate operation of the machine as soon as it is connected. Finally, relatively simple means are provided to adjust the speed and arc cf deliveries of the pitched balls.

While the invention has been described in connection with various timing circuits for automatic control, it may be desirable to operate the machine by manually delivering a ball at a time to the arm and then actuate a switch to operate the movement of the arm to pitch the ball.

What is claimed is:

1. In a machine for pitching one or more balls at selected intervals at a predetermined speed and at a predetermined angle, the combination comprising:

a. a motor including a flywheel connected thereto,
b. means for driving said motor,
c. a ball throwing arm rotatably connected to an eccentric cam shaft and disposed to receive one or more balls one at a time,
d. drive means connected to said eccentric cam shaft to move said ball throwing arm at a relatively high speed to throw a ball disposed thereon and return said arm to its original position after only one revolution,
e. condition responsive means to detect when a ball is to be pitched, and
f. a clutch mechanism including a movable element normally retracted from said flywheel and responsive to said condition responsive means to directly connect said flywheel to said drive means to cause a ball disposed on said arm to be thrown and to disconnect said flywheel from said clutch mechanism after a ball has been thrown.

2. In a machine for pitching one or more balls at selected intervals at a predetermined speed and at a predetermined angle, the combination comprising:

a. a motor including a flywheel connected thereto,
b. means for driving said motor,
c. a movable ball throwing arm rotatably connected to an eccentric cam shaft and disposed to receive said one or more balls at a time,
d. drive means connected to an eccentrically mounted shaft to move said ball throwing arm at a relatively high speed to throw a ball disposed thereon and return said arm to its original position after only one revolution,
e. condition responsive means to detect when a ball is to be pitch,
f. a clutch mechanism including a movable element normally retracted from said flywheel and responsive to said condition responsive means to directly connect said flywheel to said drive means to cause a ball disposed on said arm to be thrown and to disconnect said flywheel after said ball has been thrown,
g. said condition responsive means including an electrical circuit for selectively connecting said drive means to said flywheel to move said ball throwing arm from said original position and cause a ball disposed on said arm to be thrown, and
h. mechanical means to cause said throwing arm to return to its original position after only one revolution of the flywheel to receive another ball after a ball has been thrown.

3. A combination as set forth in claim 2 wherein said electrical circuit includes relay means for controlling the release of said movable element and a switch disposed to be operated by a ball at said source to control the operation of said relay means.

4. A combination as set forth in claim 3 wherein said electrical circuit further includes a time delay means having switching means operative at periodic time intervals to control the operation of said relay means at periodic time intervals whenever a ball at said source operates said switch.

5. A combination as set forth in claim 4 wherein said throwing arm comprises a pivotable arm, and said source of balls comprises a chute for delivering a plurality of balls to said movable member, and there are further provided ball release means associated with said chute, a second relay means for operating said ball release means to permit a single ball to be moved from said chute to arm, and a second time delay means having switching means operative at periodic time intervals to control the operation of said second relay means.

6. A combination as set forth in claim 5 wherein said ball release means further includes stop means for stopping all balls in said chute except the single ball leaving said chute when said second relay means is operated.

7. A combination as set forth in claim 6 wherein said means for driving said motor and for operating said first and second relay means comprises a source of electrical power, and there are further provided a third time delay means having switching means connected between said source of power and said first and second time delay means which operate said first and second relay means, and an on-off control switch connected between said source of electrical power and said third time delay means, whereby said first and second time delay means remain inoperative after said control switch is turned on until said third time delay means is operative for a predetermined time period.

8. A combination as set forth in claim 7 wherein said pivotable arm is moved about a predetermined angle to throw a ball and return to its original position after each ball is thrown, said pivotable arm comprising a plastic material capable of flexing upon final release of a ball thereby providing added momentum to a thrown ball.

9. A combination as set forth in claim 8 wherein a pulley arrangement is provided to connect said motor to said flywheel, said pulley arrangement including a variable pitch diameter pulley wheel for changing the speed of said flywheel and said pivotable arm, whereby the speed at which a ball is thrown is variable.

10. A combination as set forth in claim 9 wherein means are provided to vary the angle at which a ball is thrown thereby controlling the height of a thrown ball from said pivotable arm.

* * * * *